US006089906A

United States Patent [19]

Juntwait

[11] Patent Number: 6,089,906

[45] Date of Patent: Jul. 18, 2000

[54] CABLE ASSEMBLY HAVING ADDITIONAL GROUNDING CONNECTOR

[75] Inventor: Eric Juntwait, Irvine, Calif.

[73] Assignee: Hon Hai Precision Ind. Co., Ltd., Taipei Hsien, Taiwan

[21] Appl. No.: 09/221,644

[22] Filed: Dec. 28, 1998

[51] Int. Cl.[7] ..... H01R 12/24

[52] U.S. Cl. ..... 439/497

[58] Field of Search ..... 439/492–497; 29/858, 861, 866

[56] References Cited

U.S. PATENT DOCUMENTS 5,041,009 8/1991 McCleerey ..... 439/405

5,967,832 10/1999 Ploehn ..... 439/497

*Primary Examiner*—Steven L. Stephan

*Assistant Examiner*—Barry M. L. Standig

*Attorney, Agent, or Firm*—Wei Te Chung

[57] ABSTRACT

A cable assembly comprises first and second connectors and a ground plane cable. The first connector includes a first housing having front and rear faces. An array of passageways is defined between the front and rear faces. Each passageway securely receives a first terminal therein. Each first terminal forms an insulation displacement section extending beyond the rear face and a pin section extending beyond the front face. A first cover is assembled to the rear face of the first housing. The second IDC connector includes a second housing having front and rear faces. A row of second terminals is assembled to the second housing. Each terminal includes a tip extending beyond a top face of the second housing and an insulation displacement section extending beyond the rear face of the second housing. A second cover is assembled to the rear face of the second housing. The ground plane cable is terminates at the rear faces of the first and second housings by means of the first and second covers. A ground plane of the cable is electrically connected with the tips of the second IDC connector.

5 Claims, 1 Drawing Sheet

CABLE ASSEMBLY HAVING ADDITIONAL GROUNDING CONNECTOR

FIELD OF THE INVENTION

The present invention relates to a cable assembly, and more particularly to a cable assembly having an additional ground connector for connecting grounding conductors to a ground plane of a cable thereby ensuring reliable signal transmission.

DESCRIPTION OF THE PRIOR ART

As the speed of signal transmission through a cable assembly increases, the need to isolate and protect signal lines from electrical noise becomes important. One existing method for achieving this is performed by using a ground plane ribbon cable which includes a ground plane attached to conductive wires. The ground plane acts as a barrier to shield the signal lines within the conductive wires from being adversely affected by noise. In addition, a certain number of conductive wires within the cable are grounded to ensure reliable signal transmission.

SUMMARY OF THE INVENTION

An objective of this invention is to provide a cable assembly having an additional connector for connecting grounding conductors to a ground plane of a cable thereby ensuring reliable signal transmission.

In order to achieve the objective set forth, a cable assembly in accordance with the present invention comprises first and second connectors and a ground plane cable. The first connector includes a first housing having front and rear faces. An array of passageways is defined between the front and rear faces. Each passageway securely receives a first terminal therein. Each first terminal forms an insulation displacement section extending beyond the rear face and a pin section extending beyond the front face. A first cover is assembled to the rear face of the first housing. The second IDC connector includes a second housing having front and rear faces. A row of second terminals is assembled to the second housing. Each terminal has a tip extending beyond a top face of the second housing and an insulation displacement section extending beyond the rear face of the second housing. A second cover is assembled to the rear face of the second housing. The ground plane cable terminates at the rear faces of the first and second housings by means of the first and second covers. A ground plane of the cable is electrically connected with the tips of the second IDC connector.

BRIEF DESCRIPTION OF DRAWINGS

The present invention will be apparent to those skilled in the art by reading the following description of the preferred embodiment thereof, with reference to the accompanying drawing, in which.

DETAILED DESCRIPTION OF PREFERRED EMBODIMENT

Figure 1:
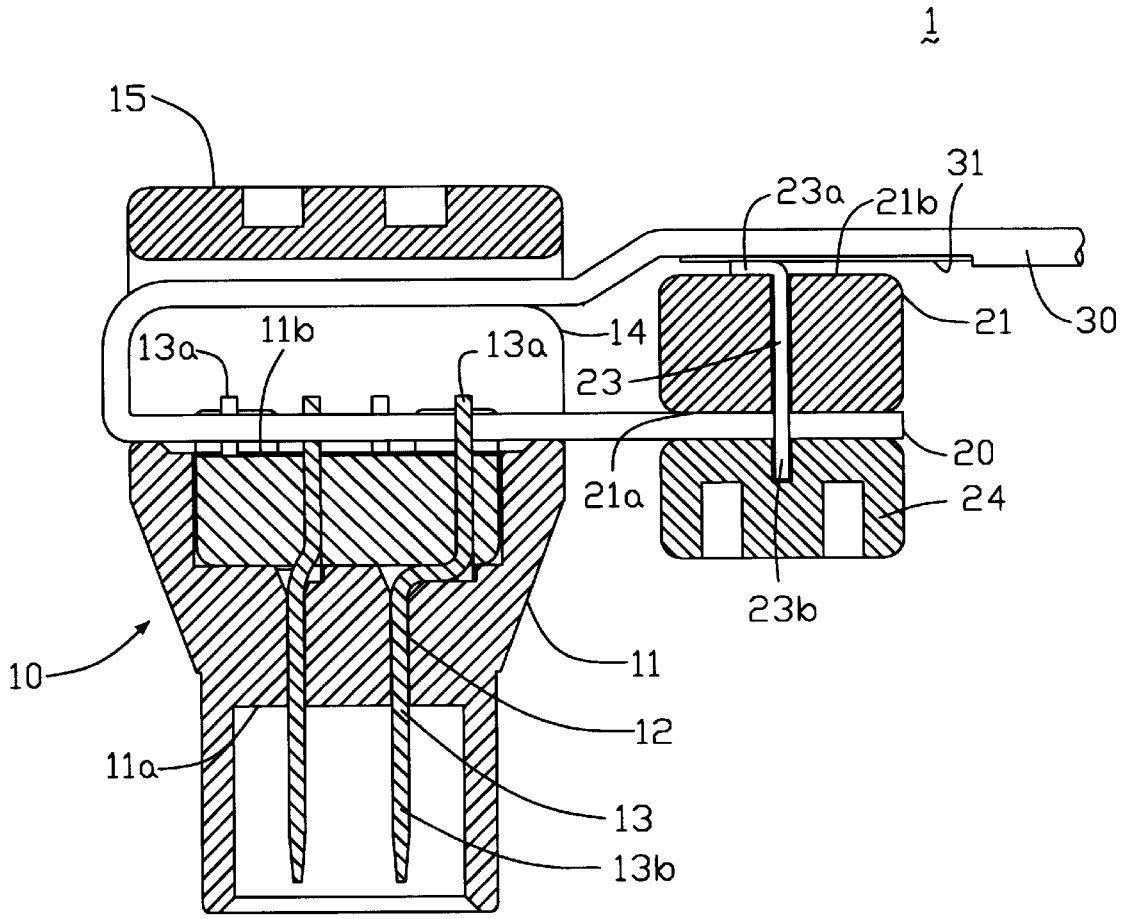
FIG. 1 is a cross sectional view of a cable assembly in accordance with the present invention.

Referring to FIG. 1, a cable assembly 1 in accordance with the present invention comprises first and second connectors 10, 20 and a ground plane cable 30. The first insulation displacement contact (IDC) connector 10 includes a first housing 11 having front and rear faces 11*a*, 11*b*. An array of passageways 12 is defined between the front and rear faces 11*a*, 11*b*. Each passageway 12 securely receives a first terminal 13 therein. Each first terminal 13 forms an insulation displacement section 13*a* extending beyond the rear face 11*b* and a pin section 13*b* extending beyond the front face 11*a*. A first cover 14 is assembled to the rear face 11*b* of the first housing 11.

The second IDC connector 20 includes a second housing 21 having front and rear faces 21*a*, 21*b*. A row of second terminals 23 is assembled to the second housing 21. Each second terminal 23 has a tip 23*a* extending beyond the rear face 21*b* of the second housing 21 and an insulation displacement section 23*b* extending beyond the front face 21*a* of the second housing 21. A second cover 24 is assembled to the rear face 21*b* of the second housing 21.

A ground plane cable 30 includes a plurality of signal and ground conductors and a ground plane thereof. The cable 30 terminate at the insulation displacement sections 13*a* of the terminals 13 by assembling the first cover 14 to the first housing 11 wherein some ground conductors further terminate at the insulation displacement sections 23*b* of the second terminals 23 by assembling the second cover 24 to the second housing 21. An exposed ground plane 31 of the cable 30 electrically connects with the tips 23*a* of the second IDC connector 20. The tips 23*a* can be soldered to the ground plane 31.

A strain relief 15 is assembled to the first cover 14 whereby excess force is prevented from acting on the connection between the cable 30 and the insulation displacement sections 23*a*.

Although the present invention has been described with reference to a preferred embodiment thereof, it is apparent to those skilled in the art that a variety of modifications and changes may be made without departing from the scope of the present invention which is intended to be defined by the appended claims.

I claim:

1. A cable assembly, comprising:

a first insulation displacement contact connector, including:

a first housing having front and rear faces, an array of passageways defined between said front and rear faces, each passageway securely receiving a first terminal therein, each said first terminal forming an insulation displacement section extending beyond said rear face and a pin section extending beyond said front face, a first cover assembled to said rear face of said first housing;

a second insulation displacement contact connector including a second housing having front and rear faces, a row of second terminals assembled to said second housing, each terminals having a tip extending beyond a top face of said second housing and an insulation displacement section extending beyond said rear face of said second housing, a second cover assembled to said rear face of said second housing; and a ground plane cable terminating at said rear faces of said first and second housings by means of said first and second covers, said cable including a plurality conductors terminating at said insulation displacement sections of said first and second terminals, a ground plane of said cable being electrically connected with said tips of said second insulation displacement contact connector.

2. The cable assembly as recited in claim 1, wherein a strain relief is assembled to said first cover.

3. A cable assembly, comprising:

a first connector including:

a first housing defining front and rear faces with a plurality of first terminals extending therebetween, each of said first terminals including a first insulation displacement section and a mating pin section thereof for mating with a complementary connector;

a second connector including:

a second housing including a plurality of second terminals therein, each of said second terminals including a second insulation displacement section thereof;

a ground plane cable including a plurality of conductors, and a ground plane wherein the first connector and the second connector are spaced from each other, and the cable terminates at the first insulation displacement section of the first terminals, while some specific conductors thereof further terminate at second insulation displacement section of the second terminals.

4. The cable assembly as recited in claim 3, wherein each of said second terminals is electrically connected to the ground plane.

5. A method of grounding specific conductors of a cable, comprising the steps of:

providing a first housing with a plurality of first terminals, each of said first terminals including a first insulation displacement section and a mating pin section thereof;

providing a second housing with a plurality of second terminals, each of said second terminals including a second insulation displacement section and a engagement tip thereof;

providing a ground plane cable with a plurality of conductors and a ground plane thereof;

terminating the cable at the first insulation displacement section of the first terminals;

terminating some said conductors at the second insulation displacement section of the second terminals; and electrically connecting the engagement tip of the second terminals to the ground plane beside the first housing.

* * * * *